United States Patent [19]

Hübner

[11] 4,393,323

[45] Jul. 12, 1983

[54] FLUORESCENT LAMP SHIELD

[75] Inventor: Fritz Hübner, Zeeland, Mich.

[73] Assignee: Plascore, Inc., Zeeland, Mich.

[21] Appl. No.: 227,965

[22] Filed: Jan. 23, 1981

[51] Int. Cl.[3] ..... H01J 5/16; H01K 1/28

[52] U.S. Cl. ..... 313/110; 362/223; 362/248

[58] Field of Search ..... 362/225, 223, 248; 313/110

[56] References Cited

U.S. PATENT DOCUMENTS

| | | | |
|---|---|---|---|
| 2,038,049 | 4/1936 | Kirsten | 176/126 |
| 2,530,990 | 11/1950 | Peters | 176/122 |
| 3,456,103 | 7/1969 | Bond | 240/26 |
| 3,564,234 | 2/1971 | Phlieger, Jr. | 240/51.11 |
| 3,673,401 | 6/1972 | Du Pont | 240/11.4 |
| 3,798,481 | 3/1974 | Pollara | 313/110 |

*Primary Examiner*—Robert Segal

*Attorney, Agent, or Firm*—Price, Heneveld, Huizenga & Cooper

[57] ABSTRACT

An assembly for shielding a fluorescent light tube is disclosed. The assembly includes an elongated plastic, tubular shield having an inner peripheral surface and which is adapted to be disposed around the light tube. An elongated, expanded metal, generally tubular shaped heat sink is positioned adjacent the inner peripheral surface of the shield. The shield and heat sink are supported around the light tube by a pair of end caps.

5 Claims, 3 Drawing Figures

FLUORESCENT LAMP SHIELD

BACKGROUND OF THE INVENTION

The present invention relates to protective assemblies for lamps and more particularly to a protective shield assembly for fluorescent light tubes.

Heretofore, various proposals have been made for protecting or shielding fluorescent tubes. Typically, light shields are fabricated as elongated tubes of unbreakable plastic, such as polycarbonate. The shields are provided to protect plant personnel, for example, from injury in the event of fluorescent tube breakage. Such shields are also required for fluorescent tubes suspended over exposed food in restaurants and the like.

With such light shields, however, a problem is presented with "high output" and "very high output" fluorescent light units. Such fluorescent units draw electricity in the 800 to 1500 milliamperes range during normal operation. Excessive heat generation at the lamp cathodes may cause blistering, discoloration, cracking and/or charring of the plastic, tubular light shields. In order to prevent such damage to the tubes, it has been proposed to employ a heat shield or sink which extends towards the center of the tube and is supported adjacent the end of the tube at the high heat area. An example of one such heat shield may be found in U.S. Pat. No. 3,798,481, entitled FLUORESCENT LAMP HEAT SHIELD and issued on Mar. 19, 1974, to Pollara. The heat shield disclosed therein is a "window screen" wire mesh member defined by a plurality of woven longitudinally extending and circumferentially extending wires. The woven wire elements cross each other substantially perpendicularly. At each point of crossing, the wires are pressed into intimate contact to produce wire deformation. The weaving and flattening is apparently necessary to achieve the desired heat transfer characteristics.

SUMMARY OF THE INVENTION

In accordance with the present invention, a unique protective shield assembly is provided with improved heat transfer characteristics. Essentially, the assembly includes an elongated tube of plastic material, such as polycarbonate, which is supported around a fluorescent light tube by a pair of end caps. Positioned at each end of the tube is a tubular shaped heat shield or sink shaped from an expanded metal cloth. The expanded metal cloth is formed by slitting and expanding or yanking a flat sheet of metal material. The expanded metal heat shield has uniform thickness and is a single, integral member. The expanded metal cloth defines a plurality of apertures which extend diagonally along the longitudinal length of the cloth. The diagonal configuration allows each of the strands to transmit heat away from a high heat zone adjacent the cathode of the fluorescent tube. In contrast, the prior woven wire mesh approach transferred heat only by the longitudinally extending wires. Potential discontinuities and loss of transfer efficiency if the wires of the prior mesh are not pressed into contact are eliminated since the present invention employs an integral sheet of metal material. Improved and more uniform heat transfer characteristics are achieved with increased ease of manufacture and assembly.

DETAILED DESCRIPTION OF THE PREFERRED EMBODIMENT

Figure 1:
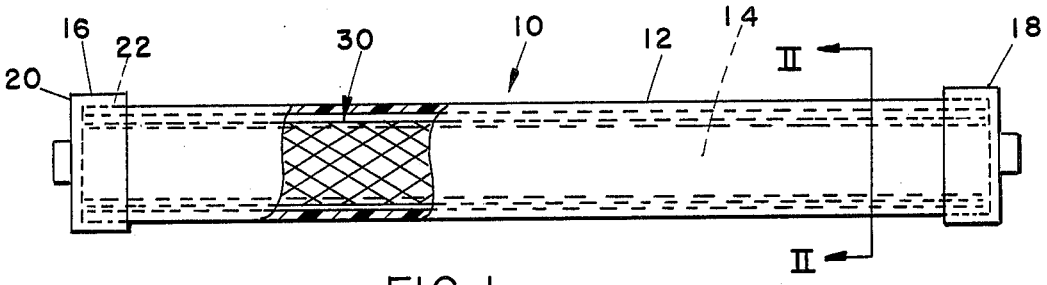
FIG. 1 is an elevational view of a fluorescent light tube and protective shield assembly in accordance with the present invention.

The preferred embodiment of the fluorescent lamp tube protective assembly in accordance with the present invention is illustrated in FIG. 1 and generally designated 10. Assembly 10 includes an elongated tubular lamp shield 12 supported about the fluorescent light tube 14 by end caps 16, 18. End caps 16, 18 are identical and of known configuration. Each cap includes a cylindrical or hub-like portion 20 defining an annular groove 22 dimensioned to receive an end of the fluorescent light shield 12. Shield 12 is of the general type disclosed in the aforementioned U.S. Pat. No. 3,798,481 and is made, for example, from polycarbonate plastic material.

Figure 2:
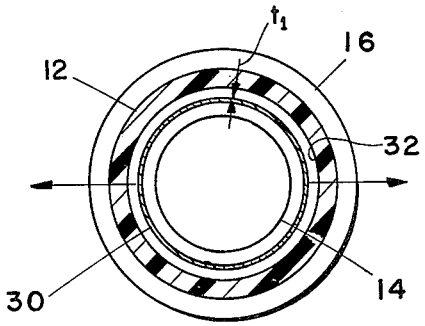
FIG. 2 is a cross-sectional view taken generally along line II—II of FIG. 1.

With high output and very high output fluorescent light tube units, the heat adjacent the cathode may be sufficient to blister, melt or otherwise damage the tubular shield 12. In order to prevent such damage, the present invention incorporates a heat sink or shield 30 supported at each end of tube 12. Heat shield 30 is an expanded metal member which is rolled into a tubular configuration and disposed within tube 12. As seen in FIG. 2, member 30 is positioned closely adjacent the inner peripheral surface 32 of tube 12.

The heat sink 30 is an integral or one-piece member fabricated from a sheet of metal material by slitting and pulling or yanking the material to expand same. The manufacturing process is conventional.

Figure 3:
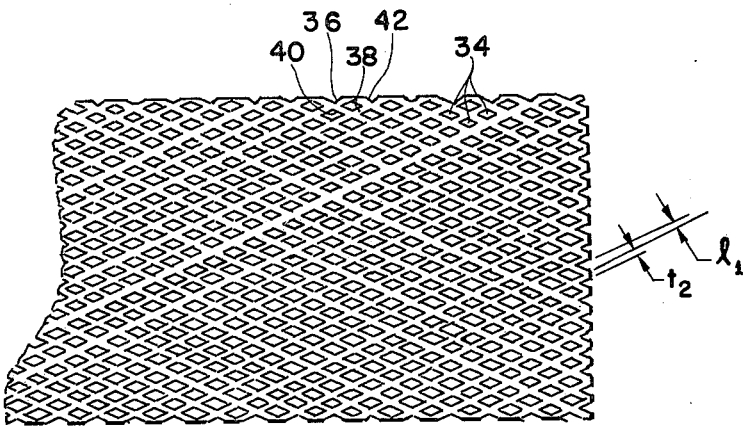
FIG. 3 is an enlarged, fragmentary view of a portion of the expanded metal heat sink material incorporated in the present invention.

As best seen in FIG. 3, the expanded metal cloth defines a plurality of generally diamond-shaped apertures 34. Each aperture is bounded by a first set of parallel strips 36, 38 and a second set of parallel strips 40, 42. The strips all extend diagonally with respect to the longitudinal axis of the tube, as is clearly seen in FIG. 1. As a result, each of the strips of metal 36–42 conduct heat away from the high heat zone of the lamp assembly.

In a presently existing embodiment of the heat sink in accordance with the present invention, an expanded metal cloth fabricated from aluminum material is employed. The aluminum sheet has a thickness $t_1$ (FIG. 2) of 0.010 inches. Each of the strips 36–42 has a length dimension $l_1$ (FIG. 3) of approximately 0.040 inches. Each strip also has a transverse dimension $t_2$ of approximately 0.070 inches.

In assembling the protective shield in accordance with the present invention, a suitable length of the above described expanded metal cloth is rolled into a tubular configuration with the transverse or lateral ends thereof overlapping. The cloth may then be inserted into an end of shield 12 and then expanded outwardly, as schematically illustrated by the arrows in FIG. 2, until it is moved into close adjacency with the inner peripheral surface 32 of tube 12. Tube 12 with the heat sinks or shields 30 in position is then slipped over a fluorescent tube 14. End caps 16, 18 are positioned on the ends of the tube. The end caps receive the ends of the tube and also receive and hold in place the heat sink or shield 30.

The expanded metal cloth employed for the heat sink of the present invention increases the ease of assembly since it is not as flexible as the prior woven wire mesh. The material is more easily handled, rolled into the desired shape and inserted into the open ends of the shield tube. The expanded metal cloth may also be shipped to the ultimate user in a flat condition. The prior "window screen" woven mesh is typically shipped in a rolled configuration. The integral nature of the shield of the present invention eliminates heat transfer inefficiency caused by noncontacting wires of the prior wire mesh structure. Also, the expanded metal cloth is more easily manufactured than the wire screen woven mesh material. All elements of the heat sink in accordance with the present invention serve to transmit heat away from the high heat zone areas of the fluorescent tube assembly. Significant advantages are, therefore, achieved.

In view of the foregoing description, those of ordinary skill in the art will undoubtedly envision various modifications to the present invention which would not depart from the inventive concepts incorporated therein. For example, the precise thickness and dimension of the apertures of the heat screen may be varied somewhat from the preferred values presently employed. The aperture size is selected to minimize light blockage yet still achieve the desired heat transfer characteristics. Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows.

1. An assembly for shielding a fluorescent light tube, comprising:

an elongated plastic, tubular shield having an inner peripheral surface;

an elongated, one-piece expanded metal tubular shaped heat sink positioned within the shield and adjacent the inner peripheral surface of the shield, said heat sink defining a plurality of rows of apertures; and a pair of end caps positioned one at each end of said shield, said end caps including means for receiving the ends of said shield to support the assembly about the light tube.

2. An assembly as defined by claim 1 wherein said heat sink is a one-piece expanded metal cloth formed by slitting and expanding a sheet of metal material to define said apertures.

3. An assembly as defined by claim 2 wherein said apertures of said cloth are arranged in a plurality of diagonal rows.

4. An assembly as defined by claim 3 wherein each of said apertures is bounded by generally parallel strips of metal and wherein all of said strips lie in the same plane when said cloth is unrolled to a flat condition.

5. An assembly as defined by claim 4 wherein said cloth is formed from an aluminum sheet having a thickness of approximately 0.010 inches and wherein each of said apertures is generally diamond-shaped and said parallel strips each have a length of approximately 0.040 inches and a transverse dimension of approximately 0.070 inches.

* * * * *